US005226490A

United States Patent [19]

Ryan et al.

[11] Patent Number: 5,226,490

[45] Date of Patent: Jul. 13, 1993

[54] EXTRUDED TANK POCKET DESIGN FOR SEPARATOR

[75] Inventors: Richard P. Ryan, East Amherst; Gary A. Halstead, Lockport; David M. Smith, Niagara Falls, all of N.Y.

[73] Assignee: General Motors Corporation, Detroit, Mich.

[21] Appl. No.: 966,498

[22] Filed: Oct. 26, 1992

[51] Int. Cl.[5] ..... F28F 9/00

[52] U.S. Cl. ..... 165/173; 165/174; 165/176

[58] Field of Search ..... 165/173, 174, 176; 29/890.052

[56] References Cited

U.S. PATENT DOCUMENTS

| | | | |
|---|---|---|---|
| 4,936,381 | 6/1990 | Alley | 165/176 |
| 4,960,169 | 10/1990 | Granetzke | 165/173 |
| 5,009,262 | 4/1991 | Halstead | 165/140 |
| 5,042,578 | 8/1991 | Tanabe | 165/174 |
| 5,062,476 | 11/1991 | Ryan et al. | 165/173 |
| 5,123,483 | 6/1992 | Tokutake et al. | 165/176 |
| 5,125,454 | 6/1992 | Creamer et al. | 165/173 |
| 5,152,339 | 10/1992 | Calleson | 165/173 |

*Primary Examiner*—Allen J. Flanigan
*Attorney, Agent, or Firm*—Patrick M. Griffin

[57] ABSTRACT

A heat exchanger apparatus includes a pair of tanks with parallel tube passes and air centers connected therebetween for cooling the engine fluid, such as a coolant, by the air intake stream to the vehicle. The tanks are formed by an extrusion forming three sides thereof and a header is brazed thereto for forming the fluid chamber in the tanks. The extrusion includes a die formed pocket therein to receive the sides and one end of a partition member and the second end of the partition member is curved to abut the header. The curved second end has flanged ears therein that seat in segments of the die formed pocket which are laterally outwardly of spaced sides segments of the pocket to position the partition within the pocket so that an outer surface thereon will be positioned against a header to form a braze seal between the partition and both the header and the extruded tank.

2 Claims, 2 Drawing Sheets

EXTRUDED TANK POCKET DESIGN FOR SEPARATOR

TECHNICAL FIELD

The invention relates to an improved braze sealed partition for use in an extruded tank of a heat exchanger apparatus for cooling engine fluid in a motor vehicle of the type including a pair of extruded tanks with parallel tube passes joined to header plates connected to the extruded tanks and having air centers connected therebetween directing the inlet air stream of the vehicle through the tube passes in the heat exchanger.

BACKGROUND OF THE INVENTION

Heat exchangers of the type utilized in vehicle engines may be used for cooling engine coolant or refrigerant vapor, or other engine fluids. Parallel header and tank units are included with parallel tube passes extending therebetween, and air centers connected between the tube passes for directing the inlet air stream. The heat exchanger is located near the front of the vehicle for receiving air flow as the vehicle is driven in a forward direction. The engine fan tends to draw cooling air across the condenser while the vehicle is stopped or slow moving and the engine is idling.

Aluminum tanks utilized in heat exchanger apparatuses have included a separator or end piece which is to fit within the aperture formed by the walls of the tank. Internal sides of the tank generally offer only line-contact with the separator part. The interface of the separator, aluminum header and tank along the surface where alloy will flow during brazing is extremely critical to part fit-up to prevent voids. The separator edges interconnect with the tank and header at an interface which is braze sealed. If the components are misfit the braze seal may leak. In condensers, performance may decrease if Freon leaks occur internally at the separator or if Freon leaks occur externally at the separator end cap. Likewise engine cooling is adversely affected by coolant leaks. Manufacture of the parts to close sealing tolerances is critical and difficult.

One such system is disclosed in the U.S. Pat. No. 5,009,262, issued Apr. 23, 1991 in the name of Halstead et al. and assigned to the assignee of the subject invention. The patent discloses a combination radiator and condenser apparatus having extruded tank and header units with a partition therebetween for isolating the coolant and refrigerant. The extruded tanks generally comprise a longitudinal cylindrical member having end closures seated therein. The side walls of the extruded tanks have cold extruded channels formed therein to receive the side walls of the end closures when they are inserted through an access slot of the header. The mounting rail is also cold extruded to form a pocket or channel for capturing the end of the end closure. However, there the partitions are not configured to produce a repetitive precision fit which will assure a positive braze seal between the tank, the partition and the header.

SUMMARY OF THE INVENTION

The invention is a heat exchanger apparatus for a motor vehicle for cooling fluid contained therein. The apparatus includes a pair of tank units each having first and second ends with tank walls extending longitudinally therebetween for providing a fluid chamber. Parallel tube passes extend between the tank units for forming a fluid passage there between. Air center means is connected to the tube passes for conductively transferring heat from the fluid to the air flowing therethrough. The apparatus also includes at least one partition member having a peripheral edge and a face sealingly connected within the tank units to seal the fluid thereby. The tank walls include a die formed pocket with two spaced side segments and an end segment; two laterally spaced references surfaces receive side ears on a partition member seated in the pocket so as to locate an outer surface on the partition against a header to braze seal against fluid leakage therebetween and between the pocket and the partition. The tank unit comprises a tank extrusion having three side walls forming the pocket, and a separate header forms a fourth side wall of the tank unit establishing the fluid chamber wherein the header abuts against the partition member.

BRIEF DESCRIPTION OF THE DRAWINGS

Other advantages of the pre sent invention will be readily appreciated as the same becomes better understood by reference to the following detailed description when considered in connection with the accompanying drawings wherein.

DETAILED DESCRIPTION OF THE PREFERRED EMBODIMENT

Figure 1:
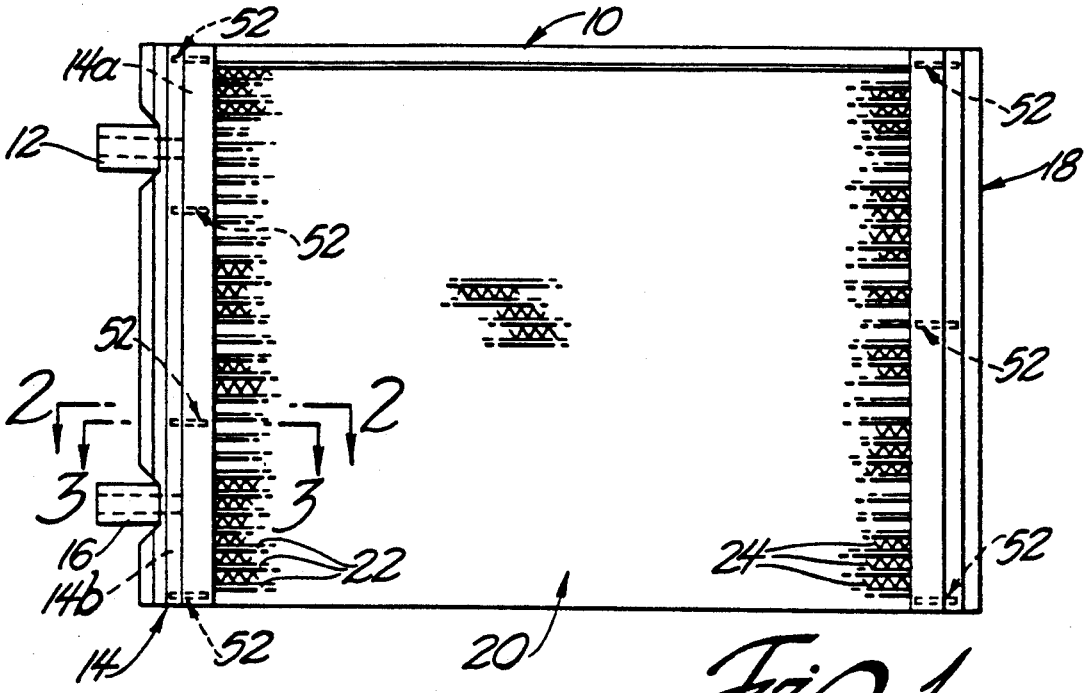
FIG. 1 is an enlarged front elevational view of the heat exchanger apparatus of the subject invention.

A heat exchanger apparatus of the present invention is shown at 10 in FIG. 1. The heat exchanger apparatus 10 is adapted to be installed as a condenser in a refrigerant system of a motor vehicle air conditioning system. A refrigerant compressor is driven by the engine to dire ct refrigerant through a hose connected to an inlet fitting 12 on a first tank 14 of the heat exchanger apparatus 10. An outlet hose returns high pressure liquid refrigerant from an outlet fitting 16 on the first tank 14 of the heat exchanger 10. A radiator section 20 of the apparatus 10 is provided between the first tank 14 and a second tank 18 and has a frontal flow area for unrestricted flow of the air intake stream of the vehicle through the cooling section 20. The cooling section 20 include s a plurality of tube passes 22 in fluid communication between the tanks 14,18 and air centers 24 connected to the tube passes 22 for directing the air intake stream of the vehicle across parallel tube passes 22 so as to extract heat from coolant flow therethrough. It is to be understood that the heat exchanger 10 may be utilized in a variety of heat exchanger applications, such as a radiator.

The first tank 14 has an inlet segment **14*a* and an outlet segment 14*b*, respectively, connected in fluid communication to the inlet fitting 12 and the outlet fitting 16. The second tank 18 forms a return tank. The tanks 14, 18 are formed by a unitary extrusion 26 and a header 28. The unitary extrusion 26 has a mounting rail 30 with a side flange 32. The mounting rail 30 and header 28 extend in a compact space saving parallel relationship. The rail 30 and header 28 extend through the vertical height of the tanks 14, 18. The extrusion 26 has spaced integral side walls 34 integrally joined to the rail 30 and brazed to the header 28 to form a coolant space or chamber 36**.

The inlet fitting 12 and outlet fitting 16 are connected to the rail 30 at spaced points thereon to communicate the coolant hoses with the coolant chambers 36 in the first tank 14. The second tank 18 is extruded as the first tank 14 except that the inlet and outlet fittings 12, 16 are not utilized.

The side walls 34 have internal integrally extruded tube stops 38 therein which merge with laterally outwardly extending curved shoulders 39 that form a V-shaped recess 41 that receives side edges **28*a*, 28*b* of the header 28 therein. The header 28 is held in place against shoulders 39 by inwardly bent ends 34*a* of each side wall 34**.

Figure 2:
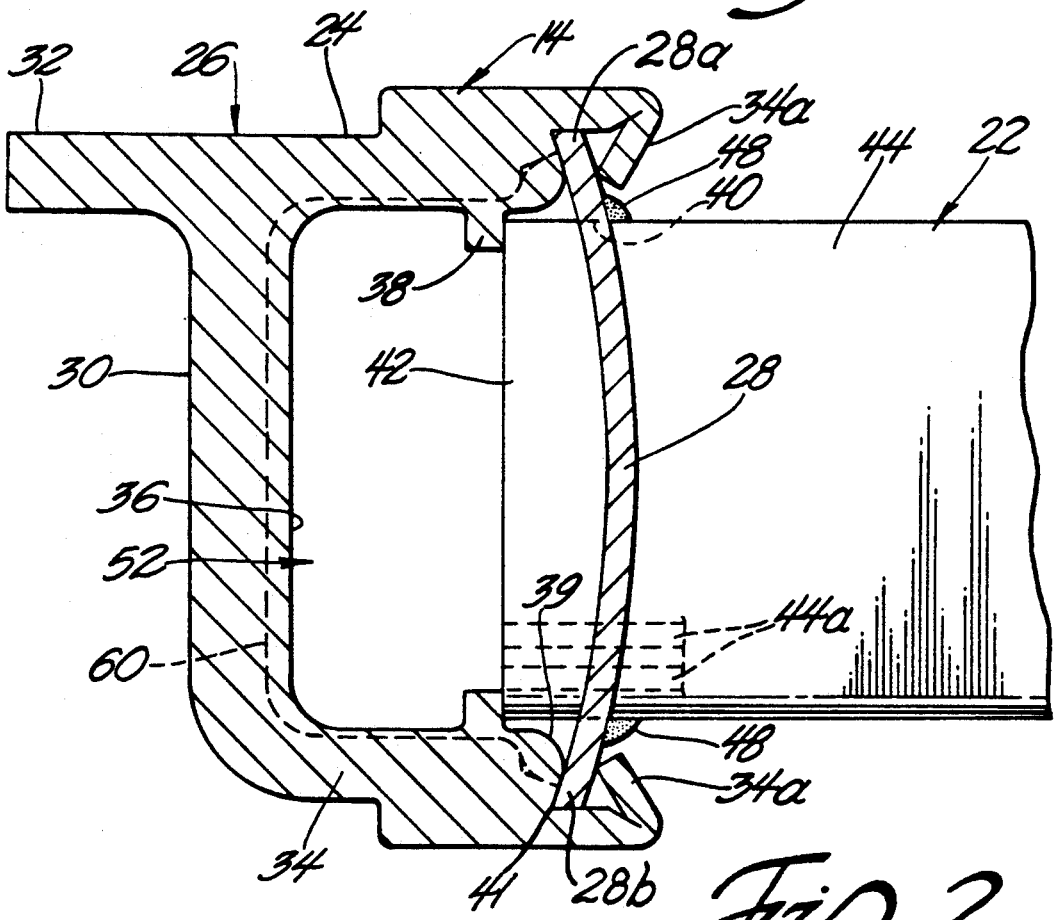
FIG. 2 is an enlarged fragmentary sectional view taken along lines 2—2 of FIG. 1 looking in the direction of arrow.
Figure 3:
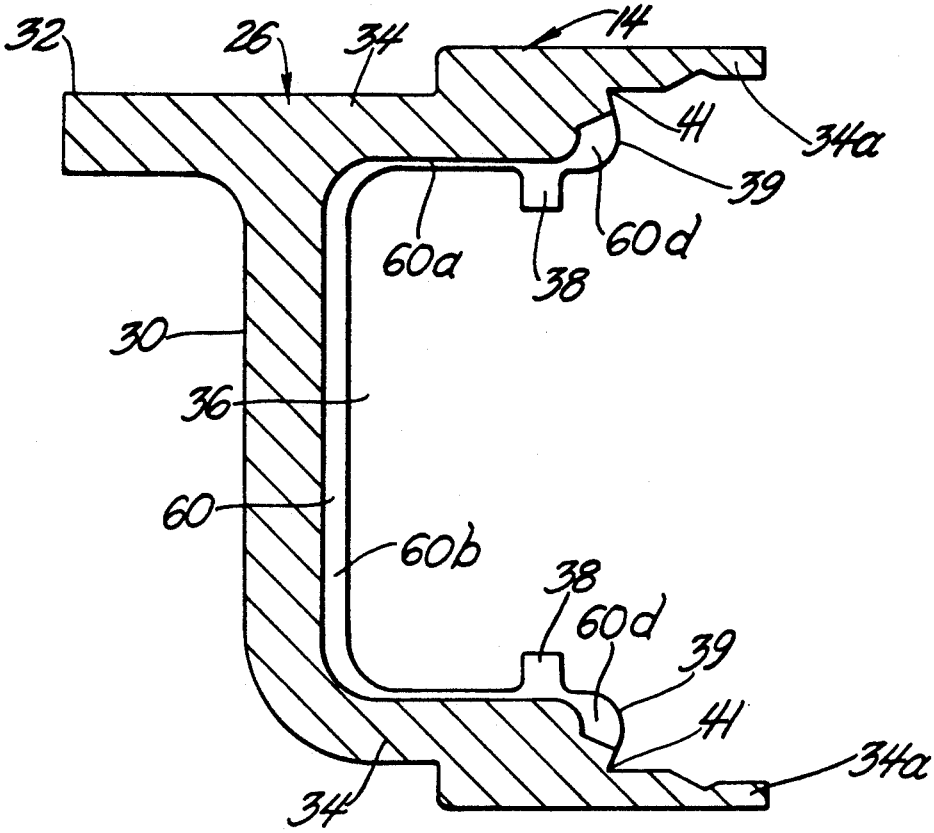
FIG. 3 is an enlarged fragmentary sectional view of the tank extrusion taken along lines 3—3 of FIG. 1.
Figure 4:
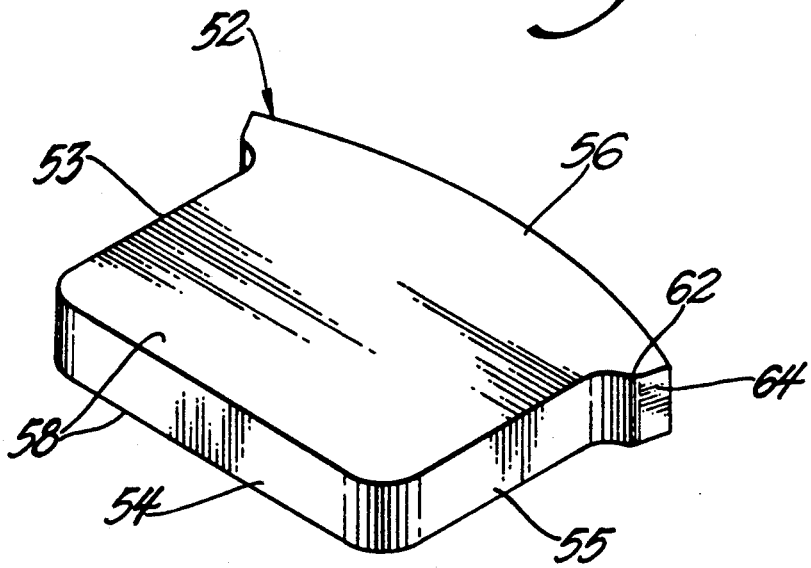
FIG. 4 is a perspective view of the partition member.

The headers 28 have a plurality of spaced tube slots 40 aligned with the tube stops 38. The tube slots 40 receive end extensions 42 on either end of an extruded tube 44 having passages **44*a* (partially outlined in FIG. 2) forming the tube passes 22 between the first tank 14 and the second tank 18. The end extensions 42 engage the tube stops 38 to locate the openings to the passages 44*a* in spaced relationship to the mounting rails 30 so as to define a gap therebetween for smooth flow of fluid from the openings to the tube passages 44*a* and the chamber 36. Cladding material on the outer surface of the header serve to form brazed joints 48 between the tube extensions 42 and the header 28 at the slots 40 therein to prevent header leakage at the tubes 44. The air centers 24 are sinusoidally curved sheet metal with peaks and valleys bonded to the outer surface of the tubes 44 in conductive heat transfer relationship therewith for removing heat from the coolant. While extruded tubes 44** are discussed, it should be understood that sheet metal tubes are equally suited for use with the present invention.

FIG. 1 illustrates the condenser apparatus 10 of a four pass flow of coolant through the cooling section 20 having the inlet fitting 12 and outlet fitting 16 on the first tank 14.

To accomplish such four pass flow, partition members 52 are sealed to the tanks 14, 18 to section the tanks 14,18 and to provide end caps to seal the coolant within the tanks 14, 18. Each of the partition members 52 comprise s a generally planar die-cut separator having a three sided 53, 54, 55, U-shaped formation having two of the sides 53, 55 opposing and extending from the third side 54, with a fourth curved side 56 extending between the two sides 53, 55 and of similar contour to the header 28. The partition members 52 also have parallel faces 58 between the four sides 53–56 that form the peripheral edge. The two opposing sides 53,55 are joined to flanged ears 62 extending outwardly from the sides 53, 55 and the fourth side 56. The ears 62 are of a predetermined width providing flat surfaces 64 between the two sides 53, 55 and the fourth side 56.

The side walls 34 and rail 30 of the extruded portion of the tank 14,18 include a die formed pocket 60 formed by cold punch extruding the rail 30 and side walls 34. The pocket 60 is configured to receive the partition member 52.

The pocket 60 is formed by a punch which pushes metal 0.01 inches deep along the side walls 34 to form side segments **60*a* and into the rail forming a 0.035–0.04 inch pocket to form an inner segment 60*b*. The thickness of the pocket is slightly greater than the thickness of the partition member 52 for receiving the partition member 52 within the pocket 60. Two spaced relief segments 60*c* are formed in the pocket 60 laterally outwardly of the side segments 60*a* to form outer shoulders 60*d* which engage ears 62 to position the partition member 52 when it slides into the pocket 60. The header 28 is assembled adjacent the partition member 52 once it is positioned by the shoulders 60*d*. The partition member 52 includes cladding material thereon which is brazed to the extrusion 26 and header 28 for providing a seal therebetween. The precise positioning provided by ears 62 will locate the inner surface 28*a* of header in engagement with the side 56 of partition 52** to assure formation of a good braze seal therebetween.

The partition member 52 and pocket 60 are also contained on three sides thereof. The pocket 60 allows better flow of the cladding material from the partition member 52 to seal the surfaces and the greater depth of the inner segment **60*b* thereof will accommodate different length partitions resulting from manufacturing tolerance variations. The pocket 60 also eliminates the variability of extrusion dimensions as tool wears insuring a consistent fit and seal. The pocket 60 completely encloses the partition member 52 allowing the header 28 to be in contact with the extrusion 26** at a braze line.

In the embodiment illustrated in FIG. 1, a pair of end enclosures 52 are utilized for each tank 14,18. The first tank 14 includes two partitions 52 spaced between the end enclosures 52, and the return tank 18 includes a single partition member 52 therein. In the preferred embodiment, the partitions 52 are generally located to allow a flow arrangement which is skewed, e.g., with a total of 32 tubes, 11 tubes connect to the inlet, 10 tubes on the return, then 6 tubes, and 5 tubes to the outlet.

The invention has been described in an illustrative manner, and while it is shown for use in a condenser it is similarly suited for use in the coolant radiators or oil coolers for use in motor vehicles or in other heat exchanger applications having an extruded member forming part of a fluid tank. It also is to be understood that the terminology which has been used is intended to be in the nature of words of description rather than of limitation.

Obviously many modifications and variations of the present invention are possible in light of the above teachings. It is, therefore, to be understood that within the scope of the appended claims the invention may be practiced otherwise than as specifically described.

The embodiments of the invention in which an exclusive property or privilege is claimed are defined as follows:

1. A heat exchanger apparatus for a motor vehicle for cooling fluid contained therein, having a pair of tank units, each having first and second ends with tank walls extending longitudinally therebetween and a header for providing a fluid chamber, and parallel tube passes extending between said tank units and through the headers for forming a fluid passage between therethrough with said tank units, and air center means connected to said tube passes for conductively transferring heat from said fluid characterized by:

at least one partition member having a peripheral edge and a face sealingly connected to said tank walls and within said tank units to seal fluid therein;

at least one of said tank walls including a pocket with a shoulder formed therein said partition member having ears therein engageable with said shoulder for positioning the partition member against said header for a braze seal therebetween.

2. A heat exchanger apparatus as set forth in claim 1 wherein said extruded tank forms a U-shaped pocket have an inner segment and two side segments, the inner segment having a greater depth than said two side segments and said shoulders formed at the ends of said two side segments, said partition member comprising a planar separator conforming to said pocket.

* * * * *